US008770929B2

(12) United States Patent
Hofer et al.

(10) Patent No.: US 8,770,929 B2
(45) Date of Patent: Jul. 8, 2014

(54) SUPERSONIC COMPRESSOR ROTOR AND METHOD OF COMPRESSING A FLUID

(75) Inventors: Douglas Carl Hofer, Clifton Park, NY (US); Dhananjayarao Gottapu, Bangalore (IN)

(73) Assignee: General Electric Company, Niskayuna, NY (US)

( * ) Notice: Subject to any disclaimer, the term of this patent is extended or adjusted under 35 U.S.C. 154(b) by 375 days.

(21) Appl. No.: 13/117,878

(22) Filed: May 27, 2011

(65) Prior Publication Data

US 2012/0301271 A1 Nov. 29, 2012

(51) Int. Cl.
*F04D 21/00* (2006.01)

(52) U.S. Cl.
USPC ..... 415/181; 416/136

(58) Field of Classification Search
USPC ..... 415/181
See application file for complete search history.

(56) References Cited

U.S. PATENT DOCUMENTS

| | | | | |
|---|---|---|---|---|
| 2,925,952 | A | 2/1960 | Garve | |
| 2,971,330 | A * | 2/1961 | Clark | 137/15.2 |
| 4,012,166 | A | 3/1977 | Kaesser et al. | |
| 4,199,296 | A | 4/1980 | de Chair | |
| 4,463,772 | A | 8/1984 | Ball | |
| 4,620,679 | A | 11/1986 | Karanian | |
| 4,704,861 | A | 11/1987 | Mowill | |
| 5,123,811 | A * | 6/1992 | Kuroiwa | 415/207 |
| 5,424,824 | A * | 6/1995 | Daiber et al. | 356/28.5 |
| 5,525,038 | A | 6/1996 | Sharma et al. | |
| 5,881,758 | A | 3/1999 | Koncsek et al. | |
| 6,358,003 | B2 | 3/2002 | Schlechtriem | |
| 6,428,271 | B1 | 8/2002 | Ress, Jr. et al. | |
| 6,488,469 | B1 | 12/2002 | Youssef et al. | |
| 7,070,388 | B2 | 7/2006 | Meng et al. | |
| 7,293,955 | B2 | 11/2007 | Lawlor et al. | |
| 7,296,396 | B1 | 11/2007 | Wilson et al. | |
| 7,334,990 | B2 | 2/2008 | Lawlor et al. | |
| 7,337,606 | B2 | 3/2008 | Brouillette et al. | |

(Continued)

FOREIGN PATENT DOCUMENTS

| | | |
|---|---|---|
| EP | 1126133 A2 | 8/2001 |
| EP | 2206928 A2 | 7/2010 |

(Continued)

OTHER PUBLICATIONS

Search Report and Written Opinion from corresponding PCT Application No. PCT/US2012/039492 dated Nov. 20, 2011.

(Continued)

*Primary Examiner* — Nathaniel Wiehe
*Assistant Examiner* — Brian O Peters
(74) *Attorney, Agent, or Firm* — Andrew J. Caruso

(57) ABSTRACT

A supersonic compressor rotor. The supersonic compressor rotor includes a substantially cylindrical disk body that includes an upstream surface, a downstream surface, and a radially outer surface that extends generally axially between the upstream surface and the downstream surface. The disk body defines a centerline axis. A plurality of vanes are coupled to the radially outer surface. Adjacent vanes form a pair and are oriented such that a flow channel is defined between each pair of adjacent vanes. The flow channel extends generally axially between an inlet opening and an outlet opening. At least one supersonic compression ramp is positioned within the flow channel. The supersonic compression ramp is selectively positionable at a first position, at a second position, and at any position therebetween.

18 Claims, 7 Drawing Sheets

(56) References Cited

U.S. PATENT DOCUMENTS

| | | | | |
|---|---|---|---|---|
| 7,434,400 | B2 | 10/2008 | Lawlor et al. | |
| 2009/0107557 | A1 | 4/2009 | Conners | |
| 2009/0196731 | A1 | 8/2009 | Lawlor | |
| 2010/0005763 | A1 | 1/2010 | Bloom | |
| 2010/0043389 | A1 | 2/2010 | Conners | |
| 2011/0142592 | A1 * | 6/2011 | Nagel et al. | 415/1 |

FOREIGN PATENT DOCUMENTS

| | | | |
|---|---|---|---|
| GB | 885661 | | 12/1961 |
| WO | 9827330 | A1 | 6/1998 |
| WO | 2009025803 | A1 | 2/2009 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 paes, Ramgen Power Systems, Bellevue, WA.

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

* cited by examiner

SUPERSONIC COMPRESSOR ROTOR AND METHOD OF COMPRESSING A FLUID

BACKGROUND OF THE INVENTION

The subject matter described herein relates generally to supersonic compressor rotors and, more particularly, to a method of operating a supersonic compressor rotor to compress a fluid.

At least some known supersonic compressor systems include a drive assembly, a drive shaft, and at least one supersonic compressor rotor for compressing a fluid. The drive assembly is coupled to the supersonic compressor rotor with the drive shaft to rotate the drive shaft and the supersonic compressor rotor.

Known supersonic compressor rotors include a plurality of strakes coupled to a rotor disk. Each strake is oriented circumferentially about the rotor disk and defines an axial flow channel between adjacent strakes. At least some known supersonic compressor rotors include a stationary supersonic compression ramp that is coupled to the rotor disk. Known supersonic compression ramps are positioned at a fixed location within the axial flow path and are configured to form a compression wave within the flow path.

During operation of known supersonic compressor systems, the drive assembly rotates the supersonic compressor rotor at a high rotational speed. A fluid is channeled to the supersonic compressor rotor such that the fluid is characterized by a velocity that is supersonic with respect to the supersonic compressor rotor at the flow channel. In known supersonic compressor rotors, a normal shockwave may be formed upstream of the supersonic compressor ramp. As fluid passes through the normal shockwave, a velocity of the fluid is reduced to subsonic with respect to the supersonic compressor rotor. As a velocity of fluid is reduced through the normal shockwave, fluid energy is also reduced. The reduction in fluid energy through the flow channel may reduce an operating efficiency of known supersonic compressor systems. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one aspect, a supersonic compressor rotor is provided. A supersonic compressor rotor includes a substantially cylindrical disk body that includes an upstream surface, a downstream surface, and a radially outer surface that extends generally axially between the upstream surface and the downstream surface. The disk body defines a centerline axis. A plurality of vanes are coupled to the radially outer surface. Adjacent vanes form a pair and are oriented such that a flow channel is defined between each pair of adjacent vanes. The flow channel extends generally axially between an inlet opening and an outlet opening. At least one supersonic compression ramp is positioned within the flow channel. The supersonic compression ramp is selectively positionable at a first position, at a second position, and at any position therebetween.

In another aspect, a supersonic compressor system is provided. A supersonic compressor system includes a casing that includes an inner surface that defines a cavity that extends between a fluid inlet and a fluid outlet. A drive shaft is positioned within the casing. The drive shaft is rotatably coupled to a driving assembly. A supersonic compressor rotor is coupled to the drive shaft. The supersonic compressor rotor is positioned between the fluid inlet and the fluid outlet for channeling fluid from the fluid inlet to the fluid outlet. The supersonic compressor rotor includes a substantially cylindrical disk body that includes an upstream surface, a downstream surface, and a radially outer surface that extends generally axially between the upstream surface and the downstream surface. The disk body defines a centerline axis. A plurality of vanes are coupled to the radially outer surface. Adjacent vanes form a pair and are oriented such that a flow channel is defined between each pair of adjacent vanes. The flow channel extends generally axially between an inlet opening and an outlet opening. At least one supersonic compression ramp is positioned within the flow channel. The supersonic compression ramp is selectively positionable at a first position, at a second position, and at any position therebetween.

In yet another aspect, the present invention provides a method of compressing a fluid using a supersonic compressor employing a supersonic compressor rotor provided by the present invention. The method includes (a) introducing a fluid to be compressed into an inlet opening of a rotating supersonic compressor rotor, said supersonic compressor rotor comprising (i) a substantially cylindrical disk body comprising an upstream surface, a downstream surface, and a radially outer surface that extends generally axially between said upstream surface and said downstream surface, said disk body defining a centerline axis; (ii) a plurality of vanes coupled to said radially outer surface, adjacent said vanes forming a pair and oriented such that a flow channel is defined between each said pair of adjacent vanes, said flow channel extending generally axially between the inlet opening and an outlet opening; and (iii) at least one supersonic compression ramp positioned within said flow channel, said supersonic compression ramp being selectively positionable at a first position, at a second position, and at any position therebetween; (b) operating the supersonic compressor rotor with the supersonic compressor ramp positioned in the first position until a normal shock wave forms downstream of a throat region defined by a trailing edge of the supersonic compressor ramp; and (c) positioning the supersonic compressor ramp in the second position, said second position being characterized by a minimum cross-sectional area which is smaller than a corresponding minimum cross-sectional area characteristic of the first position; and (d) operating the supersonic compressor rotor with the supersonic compressor ramp positioned in the second position to produce a compressed fluid.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

Figure 1:
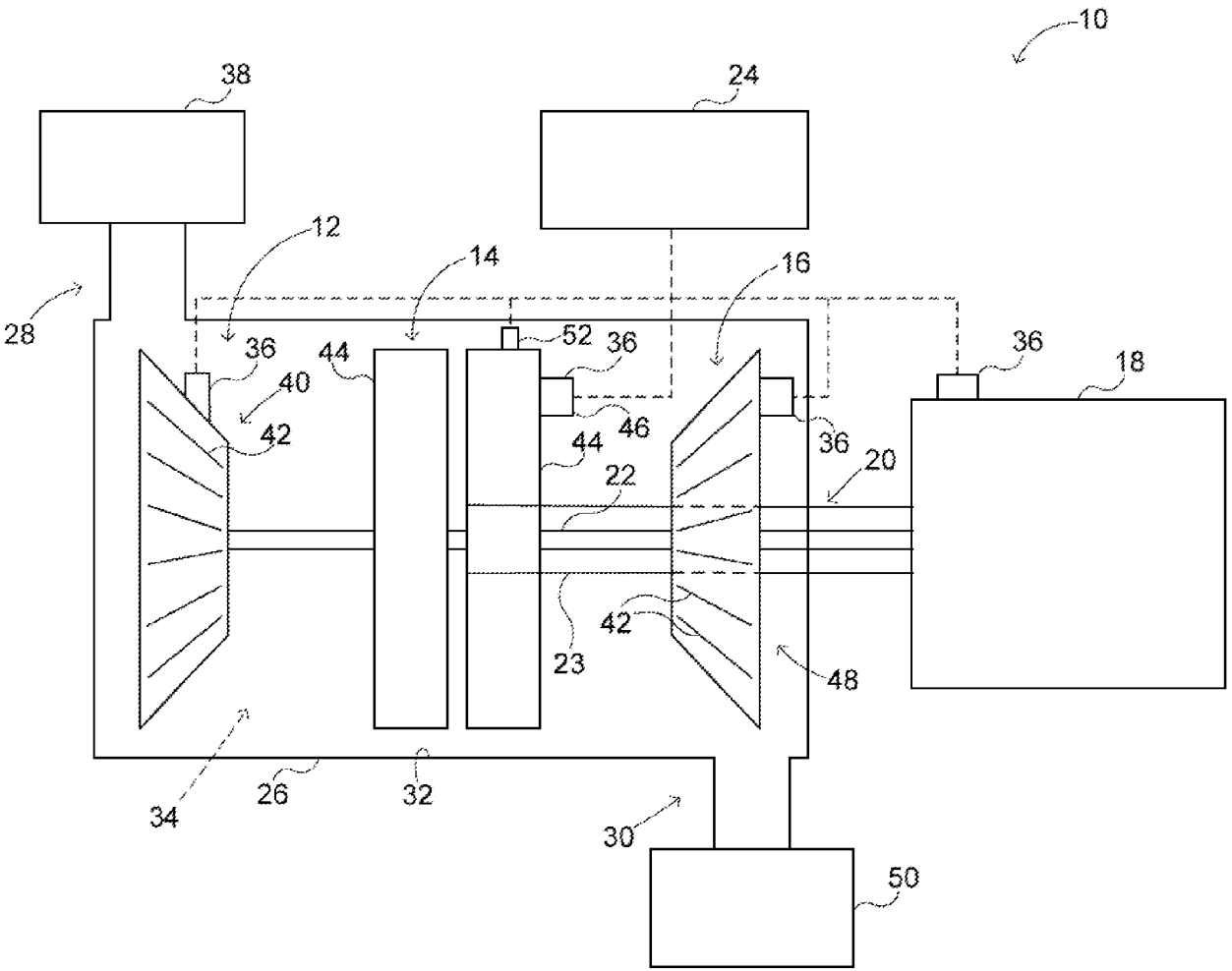
FIG. 1 is a schematic view of an exemplary supersonic compressor system.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor. Supersonic compressor rotors are said to be "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector sum of the rotor velocity at the supersonic compression ramp and the fluid velocity just prior to encountering the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressor assemblies by providing a supersonic compressor rotor that facilitates the passage of a normal shockwave formed at a first location within a flow channel of the supersonic compressor rotor during a start-up mode to a second location within the flow channel, the normal shock wave passing through a minimum cross-sectional area of the flow channel during its transit from the first location to the second location. Thereafter the supersonic compressor rotor provided by the present invention provides for greater efficiency of operation during a compression mode of operation. The supersonic compressor rotor described herein includes a supersonic compression ramp that is selectively positionable between the first position and the second position to control the size of the minimum cross-sectional area of the flow channel, at times herein referred to as the throat region. By adjusting the size of the minimum cross-sectional area the supersonic compressor rotor may be operated more efficiently than supersonic compressor rotors comprising supersonic compressor ramps which are stationary (i.e. the supersonic compressor ramps are not positionable at a first position in the flow channel, a second position in the flow channel, or any position therein between).

FIG. 1 is a schematic view of an exemplary supersonic compressor system 10. In the exemplary embodiment, supersonic compressor system 10 includes an intake section 12, a compressor section 14 coupled downstream from intake section 12, a discharge section 16 coupled downstream from compressor section 14, and a drive assembly 18. Compressor section 14 is coupled to drive assembly 18 by a rotor assembly 20 that includes an inner drive shaft 22 configured to drive a first supersonic compressor rotor 44, and an outer drive shaft 23 configured to drive a second supersonic compressor rotor. A control system 24 is coupled in operative communication with compressor section 14 and drive assembly 18 for controlling an operation of compressor section 14 and drive assembly 18. In the exemplary embodiment, each of intake section 12, compressor section 14, and discharge section 16 are positioned within a compressor housing 26. More specifically, compressor housing 26 includes a fluid inlet 28, a fluid outlet 30, and an inner surface 32 that defines a cavity 34. Cavity 34 extends between fluid inlet 28 and fluid outlet 30 and is configured to channel a fluid from fluid inlet 28 to fluid outlet 30. Each of intake section 12, compressor section 14, and discharge section 16 are positioned within cavity 34. Alternatively, intake section 12 and/or discharge section 16 may not be positioned within compressor housing 26.

During operation, supersonic compressor system 10 is monitored by several sensors 36 that detect various conditions of intake section 12, compressor section 14, discharge section 16, and drive assembly 18. Sensors 36 may include gas sensors, temperature sensors, flow sensors, speed sensors, pressure sensors and/or any other sensors that sense various parameters relative to the operation of supersonic compressor system 10. As used herein, the term "parameters" refers to physical properties whose values can be used to define the operating conditions of supersonic compressor system 10, such as temperatures, pressures, and gas flows at defined locations.

In the exemplary embodiment, fluid inlet 28 is configured to channel a flow of fluid from a fluid source 38 to intake section 12. The fluid may be any fluid such as, for example a liquid, a gas, a gas mixture, and/or a liquid-gas mixture. Intake section 12 is coupled in flow communication with compressor section 14 for channeling fluid from fluid inlet 28 to compressor section 14. Intake section 12 is configured to condition a fluid flow having one or more predetermined parameters, such as a velocity, a mass flow rate, a pressure, a temperature, and/or any suitable flow parameter. In the exemplary embodiment, intake section 12 includes an inlet guide vane assembly 40 that is coupled between fluid inlet 28 and compressor section 14 for channeling fluid from fluid inlet 28 to compressor section 14. Inlet guide vane assembly 40 includes one or more stationary inlet guide vanes 42 which may be coupled to compressor housing 26 and are stationary with respect to compressor section 14.

Compressor section 14 is coupled between intake section 12 and discharge section 16 for channeling at least a portion of fluid from intake section 12 to discharge section 16. Generally, compressor section 14 includes at least one supersonic compressor rotor 44 that is rotatably coupled to drive shaft 22. Supersonic compressor rotor 44 is configured to increase a pressure of fluid, reduce a volume of fluid, and/or increase a temperature of fluid being channeled to discharge section 16. In the exemplary embodiment, compressor section 14 includes at least one pressure sensor 46 that is configured to sense a pressure of fluid being channeled through supersonic compressor rotor 44 and transmit a signal indicative of fluid pressure to control system 24.

Discharge section 16 includes an outlet guide vane assembly 48 comprising stationary outlet guide vanes 42 that is disposed between supersonic compressor rotor 44 and fluid outlet 30 for channeling fluid from supersonic compressor rotor 44 to fluid outlet 30. Fluid outlet 30 is configured to channel fluid from outlet guide vane assembly 48 and/or supersonic compressor rotor 44 to an output system 50 such as, for example, a turbine engine system, a fluid treatment system, and/or a fluid storage system. Drive assembly 18 is configured to rotate drive shaft 22 to cause a rotation of supersonic compressor rotor 44. In the embodiment shown in FIG. 1 the supersonic compressor system 10 comprises a pair of counter-rotating supersonic compressor rotors 44. Drive assembly 20 powers each of the two supersonic compressor rotors 44 which are independently coupled to one of a pair of partially concentric drive shafts 22 and 23 (concentricity shown in FIG. 1) configured to rotate in opposite directions. In the exemplary embodiment, compressor section 14 includes at least one velocity sensor 52 that is coupled to supersonic compressor rotor 44. Velocity sensor 52 is configured to sense a rotational velocity of supersonic compressor rotor 44 and transmit a signal indicative of the rotational velocity to control system 24.

During operation, intake section 12 channels fluid from fluid source 38 towards compressor section 14. Compressor section 14 compresses the fluid and discharges the compressed fluid towards discharge section 16. Discharge section 16 channels the compressed fluid from compressor section 14 to output system 50 through fluid outlet 30.

Figure 2:
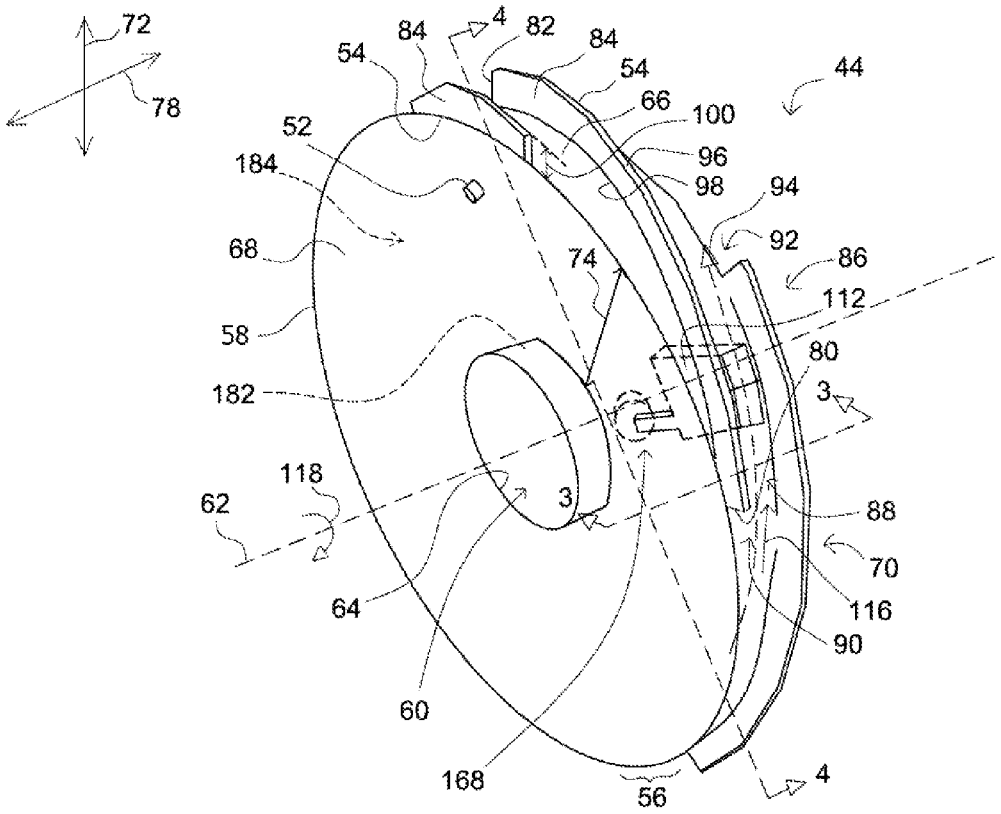
FIG. 2 is a perspective view of an exemplary supersonic compressor rotor that may be used with the supersonic compressor system shown in FIG. 1.
Figure 3:
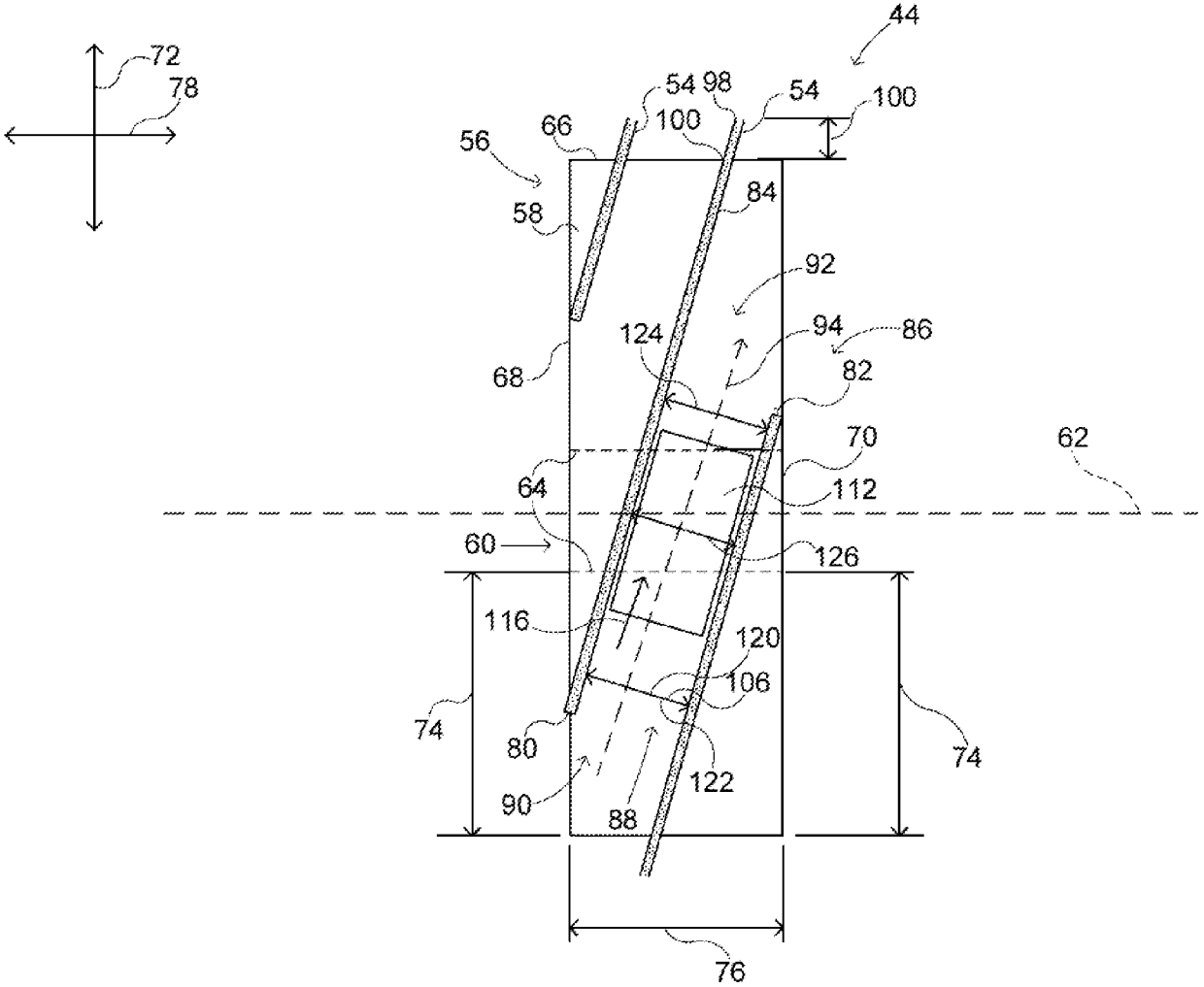
FIG. 3 is an enlarged top view of a portion of the supersonic compressor rotor shown in FIG. 2 along sectional line 3-3.
Figure 4:
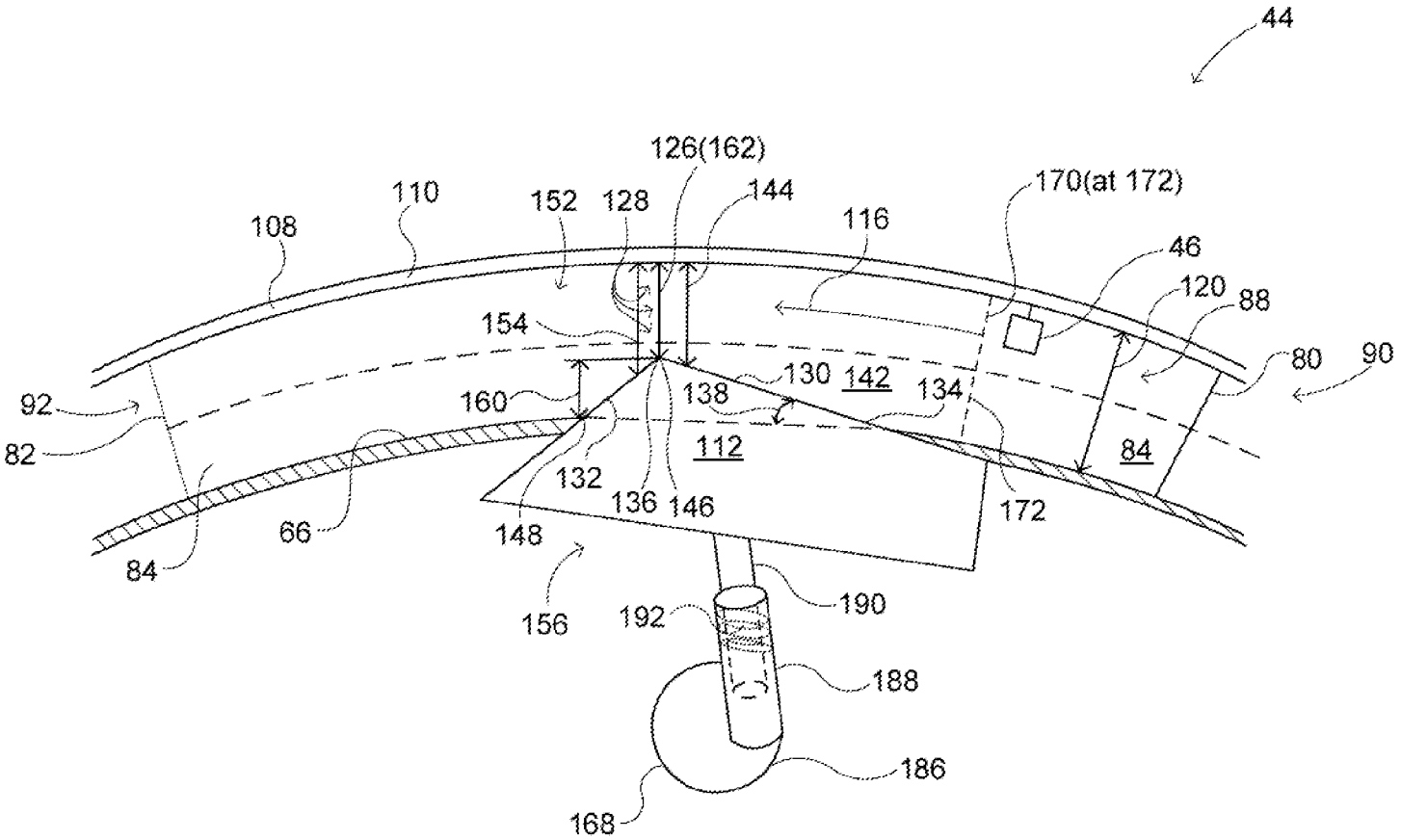
FIG. 4 is a cross-sectional view of the supersonic compressor rotor shown in FIG. 2 along sectional line 4-4, including the supersonic compressor ramp shown in a first position.
Figure 5:
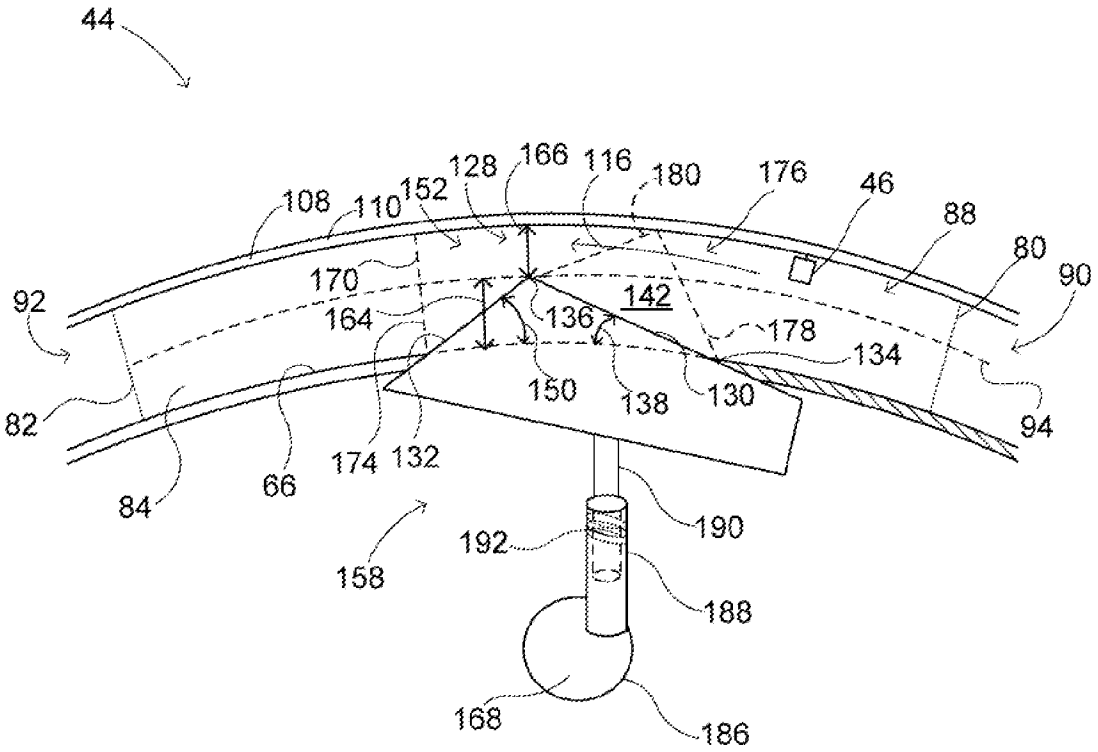
FIG. 5 is a cross-sectional view of the supersonic compressor rotor shown in FIG. 4, including the supersonic compressor ramp shown in a second position.

FIG. 2 is a perspective view of an exemplary supersonic compressor rotor 44. FIG. 3 is a sectional view of supersonic compressor rotor 44 taken along sectional line 3-3 shown in FIG. 2. FIG. 4 is a cross-sectional view of a portion of supersonic compressor rotor 44 taken along sectional line 4-4 shown in FIG. 2. FIG. 5 is a cross-sectional view of a portion of supersonic compressor rotor 44 taken along sectional line 4-4 shown in FIG. 2. Identical components shown in FIGS. 3-5 are labeled with the same reference numbers used in FIG. 2. In the exemplary embodiment, supersonic compressor rotor 44 includes a plurality of vanes 54 that are coupled to a rotor disk 56. Rotor disk 56 includes an annular disk body 58 that defines an inner cylindrical cavity 60 extending generally axially through disk body 58 along a centerline axis 62. Disk body 58 includes a radially inner surface 64 and a radially outer surface 66. Radially inner surface 64 defines inner cylindrical cavity 60. Inner cylindrical cavity 60 has a substantially cylindrical shape and is oriented about centerline axis 62. Inner cylindrical cavity 60 is sized to receive drive shaft 22 or 23 (shown in FIG. 1) therethrough. Rotor disk 56 also includes an upstream surface 68 and a downstream surface 70. Each upstream surface 68 and downstream surface 70 extends between radially inner surface 64 and radially outer surface 66 in a radial direction 72 that is generally perpendicular to centerline axis 62. Each upstream surface 68 and downstream surface 70 includes a radial width 74 that is defined between radially inner surface 64 and radially outer surface 66. Radially outer surface 66 is coupled between upstream surface 68 and downstream surface 70, and includes an axial distance 76 (FIG. 3) defined between upstream surface 68 and downstream surface 70 in an axial direction 78 that is generally parallel to centerline axis 62.

In the exemplary embodiment, each vane 54 is coupled to radially outer surface 66 and extends outwardly from radially outer surface 66. Each vane 54 extends circumferentially about rotor disk 56 in a helical shape. Each vane 54 includes an inlet edge 80, an outlet edge 82, and a sidewall 84 that extends between inlet edge 80 and outlet edge 82. Inlet edge 80 is positioned adjacent upstream surface 68. Outlet edge 82 is positioned adjacent downstream surface 70. In the exemplary embodiment, adjacent vanes 54 form a pair 86 of vanes 54 (FIG. 2). Each pair 86 is oriented to define a flow channel 88 between adjacent vanes 54. Flow channel 88 extends between an inlet opening 90 and an outlet opening 92, and defines a flow path, represented by arrow 94, that extends from inlet opening 90 to outlet opening 92. Flow path 94 is oriented generally parallel to adjacent vanes 54 and to radially outer surface 66. Flow path 94 is defined in axial direction 78 along radially outer surface 66 from inlet opening 90 to outlet opening 92. Flow channel 88 is sized, shaped, and oriented to channel fluid along flow path 94 from inlet opening 90 to outlet opening 92 in axial direction 78. Inlet opening 90 is defined between inlet edge 80 and adjacent sidewall 84. Outlet opening 92 is defined between outlet edge 82 and adjacent sidewall 84. Each sidewall 84 extends outwardly from radially outer surface 66 in radial direction 72. Sidewall 84 includes an outer surface 96 and an opposite inner surface 98. Sidewall 84 extends between outer surface 96 and inner surface 98 to define a radial height 100 of flow channel 88. Each vane 54 is spaced axially from an adjacent vane 54 such that flow channel 88 is oriented generally in axial direction 78 between inlet opening 90 and outlet opening 92. Flow channel 88 includes a width 106 that is defined between adjacent sidewalls 84 and such width 106 is defined as being perpendicular to flow path 94.

Referring to FIG. 4, in the exemplary embodiment, a shroud assembly 108 extends circumferentially about radially outer surface 66 such that flow channel 88 is defined between shroud assembly 108 and radially outer surface 66. Shroud assembly 108 includes one or more shroud plates 110. Each shroud plate 110 is coupled to outer surface 96 (FIG. 2) of each vane 54. Alternatively, supersonic compressor rotor 44 does not include shroud assembly 108. In such an embodiment, a diaphragm assembly (not shown) may be positioned adjacent outer surface 96 of each vane 54 such that the diaphragm assembly at least partially defines flow channel 88. In one embodiment, the inner surface 32 of the compressor housing (together with vanes 54, radially outer surface 66 and supersonic compressor ramp 112) serves to define the flow channel 88, in which instance the supersonic compressor rotor is configured such that the distance between outer surface 96 of vanes 54 and the inner surface 32 is minimized. Those of ordinary skill in the art will appreciate that such close tolerances between moving and stationary surfaces may be achieved using art recognized techniques.

In the exemplary embodiment, at least one supersonic compression ramp 112 is coupled to rotor disk 56 and is positioned within flow channel 88. Supersonic compression ramp 112 is positioned between inlet opening 90 and outlet opening 92, and is sized, shaped, and oriented to enable one or more compression waves to form within flow channel 88. During operation of supersonic compressor rotor 44, intake section 12 (shown in FIG. 1) channels a fluid 116 towards inlet opening 90 of flow channel 88. Fluid 116 includes a first velocity, i.e. an approach velocity, just prior to entering inlet opening 90. Drive assembly 18 (shown in FIG. 1) rotates supersonic compressor rotor 44 about centerline axis 62 at a second velocity, i.e. a rotational velocity, represented by arrow 118, such that fluid 116 entering flow channel 88 has a third velocity, i.e. an inlet velocity at inlet opening 90 that is supersonic relative to vanes 54. As fluid 116 contacts supersonic compression ramp 112 compression waves are formed within flow channel 88 to facilitate compressing fluid 116 and increase a fluid pressure, increase a fluid temperature, and/or reduce a fluid volume.

In the exemplary embodiment, flow channel 88 includes a cross-sectional area 120 (FIG. 3) that varies along flow path 94. Cross-sectional area 120 of flow channel 88 is defined perpendicularly to flow path 94 and is equal to width 106 of flow channel 88 multiplied by height 100 of flow channel 88. Flow channel 88 includes a first area, i.e. an inlet cross-sectional area 122 at inlet opening 90, a second area, i.e. an outlet cross-sectional area 124 at outlet opening 92, and a third area, i.e. a minimum cross-sectional area 126 that is defined between inlet opening 90 and outlet opening 92. In the exemplary embodiment, minimum cross-sectional area 126 is less than inlet cross-sectional area 122 and outlet cross-sectional area 124.

In the exemplary embodiment, supersonic compression ramp 112 is coupled to rotor disk 56 and is disposed partly within rotor disk 56 and partly within flow channel 88. As such, radially outer surface 66 defines at least one perforation through which supersonic compression ramp 112 extends into flow channel 88. Supersonic compression ramp 112 defines a throat region 128 of flow channel 88. Throat region 128 defines minimum cross-sectional area 126 of flow channel 88. Supersonic compression ramp 112 includes a compression surface 130 and a diverging surface 132. Compression surface 130 extends axially between adjacent vanes 54 and extends along a portion of flow channel 88 defined between inlet opening 90 and outlet opening 92. Compression surface 130 includes a first edge, i.e. a leading edge 134 and a second edge, i.e. a trailing edge 136. Leading edge 134 is positioned closer to inlet opening 90 than trailing edge 136. Compression surface 130 extends into flow channel 88 between leading edge 134 and trailing edge 136 and is oriented at an oblique angle 138 from radially outer surface 66 towards trailing edge 136 and shroud assembly 108. Trailing edge 136 extends into flow channel 88 a radial distance 160 (FIG. 4) from radially outer surface 66. Compression surface 130 converges towards shroud assembly 108 such that a compression region 142 is defined between leading edge 134 and trailing edge 136. Compression region 142 includes a converging cross-sectional area 144 of flow channel 88 that is reduced along flow path 94 from leading edge 134 to trailing edge 136. Trailing edge 136 of compression surface 130 (together with sidewalls 84 and shroud assembly 108) defines throat region 128.

Diverging surface 132 is coupled to compression surface 130 and extends downstream from compression surface 130 towards outlet opening 92. Diverging surface 132 includes a first end 146 and a second end 148 that is closer to outlet opening 92 than first end 146. First end 146 of diverging surface 132 is coupled to trailing edge 136 of compression surface 130. Diverging surface 132 extends between first end 146 and second end 148 and is oriented at an oblique angle 150 (FIG. 5) from radially outer surface 66 towards trailing edge 136 of compression surface 130. Diverging surface 132 defines a diverging region 152 that includes a diverging cross-sectional area 154 (FIG. 4) that increases from trailing edge 136 of compression surface 130 to outlet opening 92. Diverging region 152 extends from throat region 128 toward outlet opening 92.

In the exemplary embodiment, supersonic compression ramp 112 is selectively positionable between a first position 156 (FIG. 4) and a second position 158 (FIG. 5). In first position 156, supersonic compression ramp 112 extends into flow channel 88 a first radial distance 160 that is defined between radially outer surface 66 and trailing edge 136. Moreover, in first position 156, trailing edge 136 defines throat region 128 having a first minimum cross-sectional area 126 and referred to in in the embodiment shown in FIG. 4 as minimum cross-sectional area 162. In second position 158 (FIG. 5), supersonic compression ramp 112 extends into flow channel 88 a second radial distance 164 from radially outer surface 66 to trailing edge 136. Second radial distance 164 is larger than first radial distance 160 such that trailing edge 136 defines throat region 128 having a second minimum cross-sectional area 166 (126) that is smaller than first minimum cross-sectional area 162 (126).

In the exemplary embodiment, supersonic compressor rotor 44 includes an actuator assembly 168 that is operatively coupled to supersonic compression ramp 112 for moving supersonic compression ramp 112 with respect to radially outer surface 66, and between first position 156 and second position 158. Control system 24 is coupled in operative communication with actuator assembly 168 for controlling an operation of actuator assembly 168, and moving supersonic compression ramp 112 between first position 156 and second position 158.

In the exemplary embodiment, supersonic compressor rotor 44 is configured to selectively operate in a first mode, i.e. a start-up mode, and a second mode, i.e. a compression mode. As used herein, the term "start-up mode" refers to a mode of operation in which the velocity of the supersonic compressor rotor is initially insufficient to establish a normal shock wave 170 downstream of the throat region 128. In start-up mode the supersonic compression ramp 112 is positioned within flow channel 88 to facilitate the passage of a normal shockwave 170 established upstream of the throat region to a position downstream of the throat region. For example, the supersonic compressor ramp may be positioned to facilitate the passage of a normal shockwave 170 from a first location 172 (FIG. 4) within flow channel 88 that is upstream from throat region 128, and between inlet opening 90 and throat region 128 to a second location 174 (FIG. 5) which is downstream of throat region 128. Normal shockwave 170 is oriented perpendicular to flow path 94 and extends across flow path 94. As used herein, the term "compression mode" refers to a mode of operation in which the velocity of the rotor is sufficient to establish a normal shock wave downstream of the throat region, and which includes steady state operation of the supersonic compressor. It should be noted that the supersonic compressor rotor may be operated in compression mode under non-steady state conditions as well, as when, for example, one or more operating parameters (e.g. temperature, fluid composition) vary continuously during operation.

In one embodiment, during operation of supersonic compressor rotor 44 in start-up mode, supersonic compression ramp 112 is in first position 156 (FIG. 4). During start-up mode, fluid 116 enters flow channel 88 of supersonic compressor rotor 44 in which supersonic compressor ramp 112 is in first position 156, in which mode a normal shockwave 170 forms upstream of throat region 128. As the velocity of the supersonic compressor rotor increases, normal shockwave 170 moves downstream along flow path 94 and becomes established downstream of throat region 128, and the supersonic compressor rotor 44 transitions from start-up mode to compression mode. It should be noted that passage of the normal shock wave through the throat region is facilitated by a relatively large throat region cross-sectional area associated with first position 156 (FIG. 4). Once compression mode has been established, the supersonic compressor rotor may be operated with greater efficiency by further reducing the cross-sectional area 126 of the throat region (the minimum cross-sectional area of flow path 88). To this end supersonic compression ramp 112 may be shifted from first position 156 to second position 158 (FIG. 5). As supersonic compression ramp 112 moves from first position 156 to second position 158, minimum cross-sectional area 126 of throat region 128 decreases from first minimum cross-sectional area 162 (126) to second minimum cross-sectional area 166 (126). As minimum cross-sectional area 126 of flow channel 88 decreases to an appropriate cross-sectional area 166 (which may be determined simulations or experimentally by those of ordinary skill in the art), the supersonic compressor rotor may be operated more efficiently.

In one embodiment, in compression mode, supersonic compression ramp 112 is selectively positioned between first position 156 and second position 158 to cause a system 176 (FIG. 5) of compression waves to form within flow channel 88. System 176 includes a first and second oblique shockwaves 178 and 180. First oblique shock wave 178 is formed as fluid 116 encounters the leading edge 134 of supersonic compression ramp 112 and is channeled through compression region 142. Compression surface 130 causes first oblique shockwave 178 to be formed at leading edge 134 of compression surface 130. First oblique shockwave 178 extends across flow path 94 from leading edge 134 to shroud plate 110, and is oriented at an oblique angle with respect to flow path 94. First oblique shockwave 178 contacts shroud plate 110 and forms a second oblique shockwave 180 that is reflected from shroud plate 110 towards trailing edge 136 of compression surface 130 at an oblique angle with respect to flow path 94. Supersonic compression ramp 112 is configured to cause each first oblique shockwave 178 and second oblique shockwave 180 to form within compression region 142. As will be appreciated by those of ordinary skill in the art, fluid flow through each of oblique shock waves 178 and 180 is supersonic and remains supersonic until the fluid encounters and passes through normal shock wave 170 (FIG. 5).

As fluid 116 passes through compression region 142, a velocity of fluid is reduced (but as noted, remains supersonic) as fluid passes through each first oblique shockwave 178 and second oblique shockwave 180. In addition, a pressure of fluid 116 is increased, and a volume of fluid 116 is decreased. As fluid 116 passes through throat region 128, a velocity of fluid 116 is increased downstream of throat region 128 to normal shockwave 170. As fluid passes through normal shockwave 170, a velocity of fluid 116 is decreased to a subsonic velocity with respect to rotor disk 56.

In the exemplary embodiment, rotor disk 56 defines a disk cavity 184 (FIG. 2). Actuator assembly 168 is positioned within disk cavity 184 and may be coupled to an inner surface 182 (FIG. 2) of annular disk body 58 or some other suitable surface defining disk cavity 184. In the exemplary embodiment, actuator assembly 168 is a hydraulic piston-type mechanism, and includes a hydraulic pump assembly 186, a hydraulic cylinder 188, and a hydraulic piston 190. Hydraulic pump assembly 186 is coupled in flow communication with hydraulic cylinder 188 for adjusting a pressure of hydraulic fluid contained within hydraulic cylinder 188. Hydraulic piston 190 is positioned within hydraulic cylinder 188 and is configured to move with respect to hydraulic cylinder 188. A biasing mechanism 192 is coupled to hydraulic piston 190 and to hydraulic cylinder 188 to bias hydraulic piston 190 radially inward toward centerline axis 62. Hydraulic piston 190 is coupled to supersonic compression ramp 112 to move supersonic compression ramp 112 from first position 156 to second position 158, and from second position 158 to first position 156. In the exemplary embodiment, actuator assembly 168 is configured to selectively position supersonic compression ramp 112 at first position 156, at second position 158, and any position between first position 156 and second position 158.

In the exemplary embodiment, control system 24 is coupled in operative communication with hydraulic pump assembly 186 for controlling an operation of hydraulic pump assembly 186. During operation, hydraulic pump assembly 186 increases a hydraulic pressure within hydraulic cylinder 188 to move hydraulic piston 190 towards radially outer surface 66 along radial direction 72. As hydraulic pressure is increased, hydraulic piston 190 causes supersonic compression ramp 112 to move from first position 156 towards second position 158. As hydraulic pressure is decreased within hydraulic cylinder, biasing mechanism 192 moves hydraulic piston radially inwardly that causes supersonic compression ramp to move from second position 158 towards first position 156. In the embodiment shown in FIG. 4 and FIG. 5, supersonic compressor ramp 112 moves radially outward from position 156 and pivots slightly to attain position 158, said radially outward movement and said pivoting being induced and controlled by actuator assembly 168.

Figure 6:
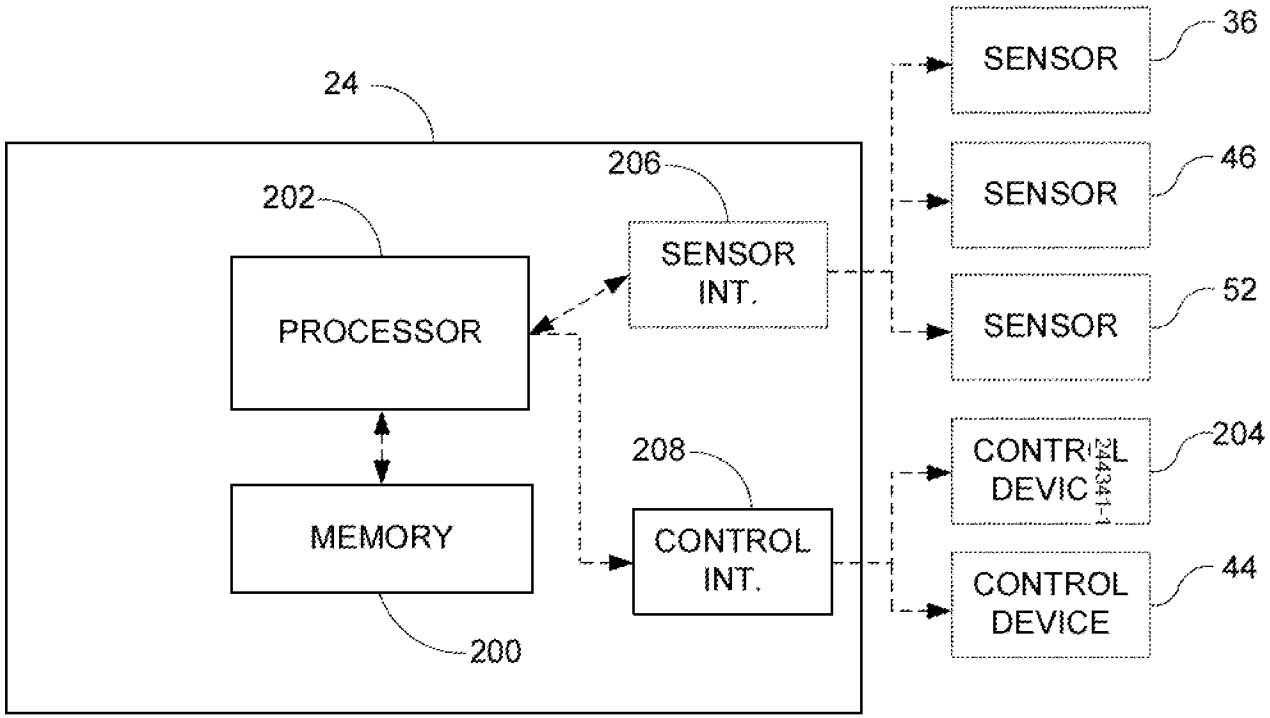
FIG. 6 is a block diagram of an exemplary control system suitable for use with the supersonic compressor system in FIG. 1.

FIG. 6 is a block diagram illustrating an exemplary control system 24. In the exemplary embodiment, control system 24 is a real-time controller that includes any suitable processor-based or microprocessor-based system, such as a computer system, that includes microcontrollers, reduced instruction set circuits (RISC), application-specific integrated circuits (ASICs), logic circuits, and/or any other circuit or processor that is capable of executing the functions described herein. In one embodiment, control system 24 is a microprocessor that includes read-only memory (ROM) and/or random access memory (RAM), such as, for example, a 32 bit microcomputer with 2 Mbit ROM and 64 Kbit RAM. As used herein, the term "real-time" refers to outcomes occurring at a substantially short period of time after a change in the inputs affect the outcome, with the time period being a design parameter that may be selected based on the importance of the outcome and/or the capability of the system processing the inputs to generate the outcome.

In the exemplary embodiment, control system 24 includes a memory area 200 configured to store executable instructions and/or one or more operating parameters representing and/or indicating an operating condition of supersonic compressor system 10. Operating parameters may represent and/or indicate, without limitation, a fluid pressure, a rotational velocity, a vibration, and/or a fluid temperature. Control system 24 further includes a processor 202 that is coupled to memory area 200 and is programmed to determine an operation of one or more supersonic compressor system control devices 204, for example, supersonic compressor rotor 44, based at least in part on one or more operating parameters. In one embodiment, processor 202 includes a processing unit, such as, without limitation, an integrated circuit (IC), an application specific integrated circuit (ASIC), a microcomputer, a programmable logic controller (PLC), and/or any other programmable circuit. Alternatively, processor 202 may include multiple processing units (e.g., in a multi-core configuration).

In the exemplary embodiment, control system 24 includes a sensor interface 206 that is coupled to at least one sensor 36 such as, for example, velocity sensor 52, and/or pressure sensor 46 for receiving one or more signals from sensor 36. Each sensor 36 generates and transmits a signal corresponding to an operating parameter of supersonic compressor system 10. Moreover, each sensor 36 may transmit a signal continuously, periodically, or only once, for example, though other signal timings are also contemplated. Furthermore, each sensor 36 may transmit a signal either in an analog form or in a digital form. Control system 24 processes the signal(s) by processor 202 to create one or more operating parameters. In some embodiments, processor 202 is programmed (e.g., with executable instructions in memory area 200) to sample a signal produced by sensor 36. For example, processor 202 may receive a continuous signal from sensor 36 and, in response, periodically (e.g., once every five seconds) calculate an operation mode of supersonic compressor rotor 44 based on the continuous signal. In some embodiments, processor 202 normalizes a signal received from sensor 36. For example, sensor 36 may produce an analog signal with a parameter (e.g., voltage) that is directly proportional to an operating parameter value. Processor 202 may be programmed to convert the analog signal to the operating parameter. In one embodiment, sensor interface 206 includes an analog-to-digital converter that converts an analog voltage signal generated by sensor 36 to a multi-bit digital signal usable by control system 24.

Control system 24 also includes a control interface 208 that is configured to control an operation of supersonic compressor system 10. In some embodiments, control interface 208 is operatively coupled to one or more supersonic compressor system control devices 204, for example, supersonic compressor rotor 44.

Various connections are available between control interface 208 and control device 204 and between sensor interface 206 and sensor 36. Such connections may include, without limitation, an electrical conductor, a low-level serial data connection, such as Recommended Standard (RS) 232 or RS-485, a high-level serial data connection, such as Universal Serial Bus (USB) or Institute of Electrical and Electronics Engineers (IEEE) 1394 (a/k/a FIREWIRE), a parallel data connection, such as IEEE 1284 or IEEE 488, a short-range wireless communication channel such as BLUETOOTH, and/or a private (e.g., inaccessible outside supersonic compressor system 10) network connection, whether wired or wireless.

Referring again to FIG. 4, in the exemplary embodiment, pressure sensor 46 is coupled to supersonic compressor rotor 44 and is configured to sense a pressure within flow channel 88. In one embodiment, pressure sensor 46 is positioned upstream of throat region 128 for sensing a pressure within compression region 142 of flow channel 88. Alternatively, pressure sensor 46 may be positioned at any suitable location to enable control system 24 to function as described herein. In the exemplary embodiment, velocity sensor 52 is coupled to supersonic compressor rotor 44 for sensing a rotational velocity of rotor disk 56.

During operation of supersonic compressor system 10, control system 24 receives from velocity sensor 52 signals indicative of a rotational velocity of supersonic compressor rotor 44 and receives from pressure sensor 46 signals indicative of a pressure of fluid 116 within flow channel 88. Control system 24 is configured to calculate a location of normal shockwave 170 within flow channel 88 based at least in part on the rotational velocity of supersonic compressor rotor 44 and the fluid pressure within flow channel 88. Control system 24 is further configured to selectively position supersonic compression ramp 112 between first position 156 and second position 158 based on the calculated location of normal shockwave 170. In one embodiment, control system 24 is configured to compare the calculated location of normal shockwave 170 with a predefined location and determine whether normal shockwave 170 is at first location 172 or second location 174. In the exemplary embodiment, control system 24 selectively positions supersonic compression ramp 112 at first position 156, at second position 158, and at any position therebetween based upon determining whether normal shockwave 170 is at first location 172 or second location 174. In an alternative embodiment, control system 24 is configured to compare a sensed fluid pressure with a predefined pressure and/or a predefined range of pressure values. If the sensed fluid pressure is different than a predefined pressure and/or is not within a predefined range of pressure values, control system 24 operates supersonic compression ramp 112 to adjust minimum cross-sectional area 126 of throat region 128 until the sensed fluid pressure is substantially equal to a predefined pressure or is within a predefined range of pressure values.

Figure 7:
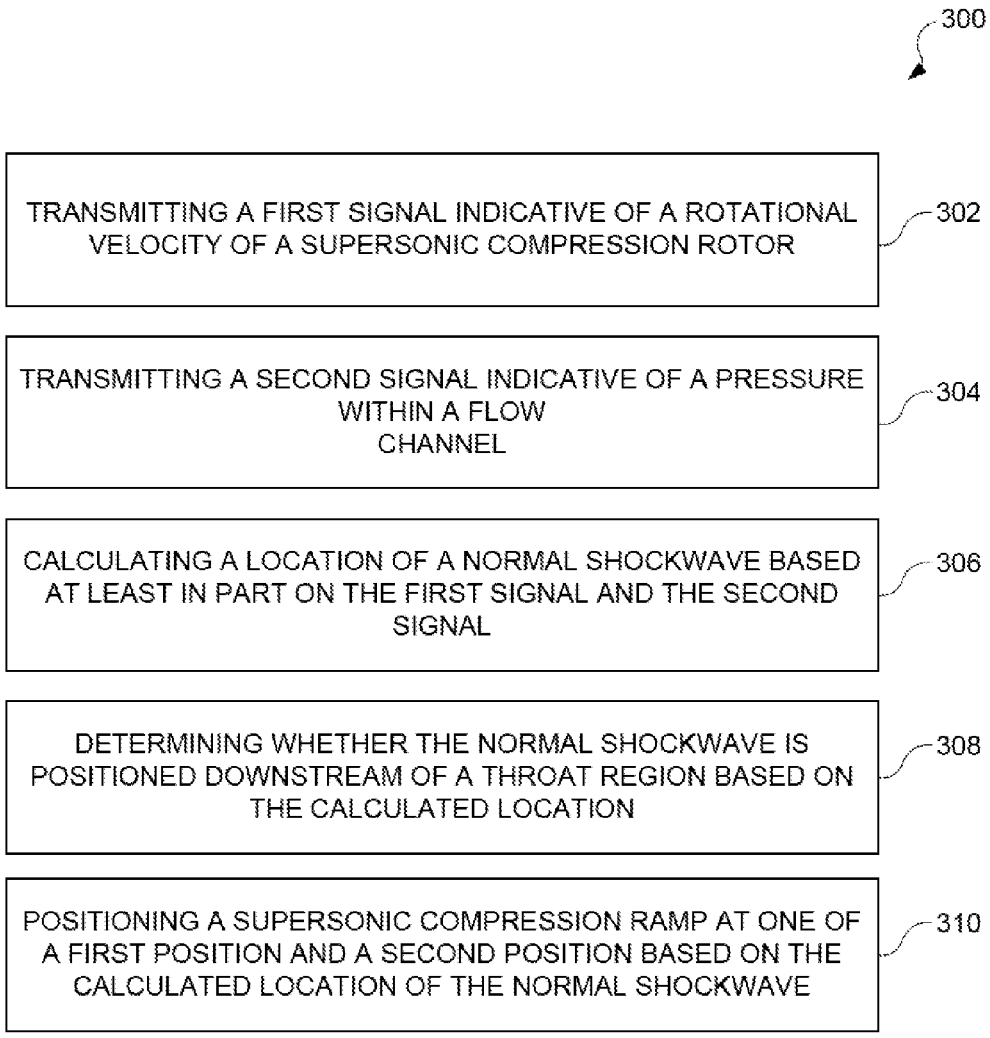
FIG. 7 is a flow chart illustrating an exemplary method of operating the supersonic compressor system shown in FIG. 1.

FIG. 7 is a flow chart illustrating an exemplary method 300 of operating supersonic compressor rotor 44 to compress a fluid. In the exemplary embodiment, method 300 includes transmitting 302 a first monitoring signal indicative of a rotational velocity of supersonic compressor rotor 44 from velocity sensor 52 to control system 24. A second monitoring signal indicative of a pressure within flow channel 88 is transmitted 304 from pressure sensor 46 to control system 24. A location of normal shockwave 170 is calculated 306 by control system 24 based at least in part on the first monitoring signal and the second monitoring signal. Control system 24 determines 308 whether normal shockwave 170 is positioned downstream of throat region 128 based on the calculated location. Control system 24 positions 310 supersonic compression ramp 112 at one of first position 156 and second position 158 based on whether normal shockwave 170 is positioned downstream of throat region 128.

An exemplary technical effect of the system, method, and apparatus described herein includes at least one of: (a) transmitting, from a first sensor to the control system, a first signal indicative of a rotational velocity of the supersonic compression rotor; (b) transmitting, from a second sensor to the control system, a second signal indicative of a pressure within a flow channel; (c) calculating the location of a normal shockwave based at least in part on the first signal and the second signal; (d) determining whether the normal shockwave is positioned downstream of the throat region based on the calculated location; and (e) positioning a supersonic compression ramp at one of a first position and a second position based on the determination of whether the normal shockwave is positioned downstream of a throat region.

The above-described supersonic compressor rotor provides a cost effective and reliable method for increasing an efficiency in performance of supersonic compressor systems. Moreover, the supersonic compressor rotor facilitates increasing the operating efficiency of the supersonic compressor system by adjusting the minimal cross-sectional area in the throat region once the desired operation condition has been attained, as indicated by the location of a normal shockwave that is formed within a flow channel downstream of the throat region. More specifically, the supersonic compressor rotor described herein includes a supersonic compression ramp that is selectively positionable between a first position and a second position to facilitate adjusting a minimum cross-sectional area of the flow channel. By adjusting the minimum cross-sectional area, the supersonic compressor rotor facilitates improving the operating efficiency of the supersonic compressor system. As such, the cost of operating and maintaining the supersonic compressor system may be reduced.

Exemplary embodiments of systems and methods for assembling a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor rotor comprising:

a substantially cylindrical disk body comprising an upstream surface, a downstream surface, and a radially outer surface that extends generally axially between said upstream surface and said downstream surface, said disk body defining a centerline axis;

a plurality of vanes coupled to said radially outer surface, adjacent said vanes forming a pair and oriented such that a flow channel is defined between each said pair of adjacent vanes, said flow channel extending generally axially between an inlet opening and an outlet opening;

at least one supersonic compression ramp comprising a leading edge and a trailing edge, said supersonic compression ramp being coupled to the disk body, said supersonic compression ramp being disposed partly within the disk body and extending through at least one perforation in the radially outer surface of the disk body into the flow channel, said supersonic compression ramp being selectively positionable such that a radial distance of the trailing edge from the radially outer surface of the disk body may be varied between a first radial distance and a second radial distance without changing the position of the leading edge within the flow channel; and a control system operatively coupled to said at least one supersonic compression ramp and configured to calculate a location of a normal shockwave within said flow channel and position said supersonic compression ramp based on the calculated location of the normal shock wave.

2. A supersonic compressor rotor in accordance with claim 1, wherein said at least one supersonic compression ramp defines a throat region of said flow channel, said throat region having a minimum cross-sectional area of said flow channel, said supersonic compression ramp configured to adjust a cross-sectional area of said throat region.

3. A supersonic compressor rotor in accordance with claim 1, further comprising an actuator coupled to said at least one supersonic compression ramp, said actuator configured to position said supersonic compression ramp at a first position, at a second position, and at any position therebetween.

4. A supersonic compressor rotor in accordance with claim 1, wherein the control system is operatively coupled to said at least one supersonic compression ramp to facilitate moving said supersonic compression ramp at a first position, at a second position, and at any position therebetween.

5. A supersonic compressor rotor in accordance with claim 4, further comprising at least a first sensor configured to sense a rotational velocity of said rotor disk and to generate at least a first monitoring signal indicative of the sensed rotational velocity, said control system communicatively coupled to said first sensor for receiving the generated first monitoring signal from said first sensor, said control system configured to calculate the location of the normal shockwave within said flow channel based on the received first monitoring signal.

6. A supersonic compressor rotor in accordance with claim 5, further comprising at least a second sensor configured to sense a pressure within said flow channel and to transmit to said control system at least a second monitoring signal indicative of the sensed pressure, said control system configured to calculate the location of the normal shockwave based on the first monitoring signal and the second monitoring signal.

7. A supersonic compressor rotor in accordance with claim 6, wherein said control system is configured to move said supersonic compression ramp upon determining that the sensed pressure is different than a predetermined pressure.

8. A supersonic compressor system comprising:

a casing comprising an inner surface defining a cavity extending between a fluid inlet and a fluid outlet;

a drive shaft positioned within said casing, said drive shaft rotatably coupled to a driving assembly; and a supersonic compressor rotor coupled to said drive shaft, said supersonic compressor rotor positioned between said fluid inlet and said fluid outlet for channeling fluid from said fluid inlet to said fluid outlet, said supersonic compressor rotor comprising:

a substantially cylindrical disk body comprising an upstream surface, a downstream surface, and a radially outer surface that extends generally axially between said upstream surface and said downstream surface, said disk body defining a centerline axis;

a plurality of vanes coupled to said radially outer surface, adjacent said vanes forming a pair and oriented such that a flow channel is defined between each said pair of adjacent vanes, said flow channel extending generally axially between an inlet opening and an outlet opening;

at least one supersonic compression ramp comprising a leading edge and a trailing edge, said supersonic compression ramp being coupled to the disk body, said supersonic compression ramp being disposed partly within the disk body and extending through at least one perforation in the radially outer surface of the disk body into the flow channel, said supersonic compression ramp being selectively positionable such that a radial distance of the trailing edge from the radially outer surface of the disk body may be varied between a first radial distance and a second radial distance without changing the position of the leading edge within the flow channel; and a control system operatively coupled to said at least one supersonic compression ramp and configured to calculate a location of a normal shockwave within said flow channel and position said supersonic compression ramp based on the calculated location of the normal shock wave.

9. A supersonic compressor system in accordance with claim 8, wherein said at least one supersonic compression ramp defines a throat region of said flow channel, said throat region having a minimum cross-sectional area of said flow channel, said supersonic compression ramp configured to adjust a cross-sectional area of said throat region.

10. A supersonic compressor system in accordance with claim 8, further comprising an actuator coupled to said at least one supersonic compression ramp, said actuator configured to position said supersonic compression ramp at a first position, at a second position, and at any position therebetween.

11. A supersonic compressor system in accordance with claim 8, wherein the control system is operatively coupled to said at least one supersonic compression ramp to facilitate moving said supersonic compression ramp at a first position, at a second position, and at any position therebetween.

12. A supersonic compressor system in accordance with claim 11, further comprising at least a first sensor configured to sense a rotational velocity of said rotor disk and to generate at least a first monitoring signal indicative of the sensed rotational velocity, said control system communicatively coupled to said first sensor for receiving the generated first monitoring signal from said first sensor, said control system configured to calculate the location of the normal shockwave within said flow channel based on the received first monitoring signal.

13. A supersonic compressor system in accordance with claim 12, further comprising at least a second sensor configured to sense a pressure within said flow channel and to transmit to said control system at least a second monitoring signal indicative of the sensed pressure, said control system configured to calculate the location of the normal shockwave based on the first monitoring signal and the second monitoring signal.

14. A supersonic compressor system in accordance with claim 13, wherein said control system is configured to position said supersonic compression ramp upon determining that the sensed pressure is different than a predetermined pressure.

15. A method of compressing a fluid, said method comprising:

(a) introducing a fluid to be compressed into an inlet opening of a rotating supersonic compressor rotor, said supersonic compressor rotor comprising (i) a substantially cylindrical disk body comprising an upstream surface, a downstream surface, and a radially outer surface that extends generally axially between said upstream surface and said downstream surface, said disk body defining a centerline axis; (ii) a plurality of vanes coupled to said radially outer surface, adjacent said vanes forming a pair and oriented such that a flow channel is defined between each said pair of adjacent vanes, said flow channel extending generally axially between the inlet opening and an outlet opening; and (iii) at least one supersonic compression ramp positioned within said flow channel, said supersonic compression ramp being selectively positionable at a first position, at a second position, and at any position therebetween, said supersonic compression ramp comprising a leading edge and a trailing edge, said supersonic compression ramp being coupled to the disk body, said supersonic compression ramp being disposed partly within the disk body and extending through at least one perforation in the radially outer surface of the disk body into the flow channel, said supersonic compression ramp being selectively positionable such that a radial distance of the trailing edge from the radially outer surface of the disk body is varied between a first radial distance and a second radial distance without changing the position of the leading edge within the flow channel;

(b) operating the supersonic compressor rotor with the supersonic compressor ramp positioned in the first position until a normal shock wave forms downstream of a throat region defined by a trailing edge of the supersonic compressor ramp;

(c) positioning the supersonic compressor ramp in the second position, said second position being characterized by a minimum cross-sectional area which is smaller than a corresponding minimum cross-sectional area characteristic of the first position;

(d) operating the supersonic compressor rotor with the supersonic compressor ramp positioned in the second position to produce a compressed fluid;

(e) calculating the location of the normal shockwave within said flow channel; and (f) positioning the supersonic compression ramp at the first position, the second position, and any position there between based on the calculated location of the normal shock wave.

16. A method in accordance with claim 15, wherein calculating the location of the normal shockwave comprises:

transmitting, from a first sensor to a control system, a first signal indicative of a rotational velocity of the supersonic compressor rotor; and, calculating the location of the normal shockwave based at least in part on the first signal.

17. A method in accordance with claim 15, wherein calculating the location of the normal shockwave comprises:

transmitting, from a second sensor to a control system, a second signal indicative of a pressure within the flow channel; and, calculating the location of the normal shockwave based at least in part on the first signal and the second signal.

18. A method in accordance with claim 17, wherein positioning the supersonic compression ramp comprises:

determining whether the normal shockwave is positioned downstream of the throat region based on the calculated location; and, positioning the supersonic compression ramp at the first position, the second position, and any position therebetween based on the determination of whether the normal shockwave is positioned downstream of the throat region.

* * * * *